US005352054A

United States Patent [19]

Lhuisset

[11] Patent Number: 5,352,054

[45] Date of Patent: Oct. 4, 1994

[54] DEVICE FOR OBTURATING AN APPLICATOR OF A LIQUID PRODUCT

[75] Inventor: François N. B. Lhuisset, Montgeron, France

[73] Assignee: L V M H Recherche, France

[21] Appl. No.: 941,064

[22] PCT Filed: Apr. 11, 1991

[86] PCT No.: PCT/FR91/00304

§ 371 Date: Nov. 10, 1992

§ 102(e) Date: Nov. 10, 1992

[87] PCT Pub. No.: WO91/15974

PCT Pub. Date: Oct. 31, 1991

[30] Foreign Application Priority Data

Apr. 12, 1990 [FR] France ..... 90 04752

[51] Int. Cl.[5] ..... A46B 11/00

[52] U.S. Cl. ..... 401/269; 401/102; 401/279

[58] Field of Search ..... 401/102, 117, 269, 279

[56] References Cited

U.S. PATENT DOCUMENTS 874,897 12/1907 Moore ..... 401/102
2,887,708 5/1959 Kane ..... 15/136
4,902,152 2/1990 Seidler ..... 401/117
4,930,922 6/1990 La Rosa et al. ..... 401/117 X

FOREIGN PATENT DOCUMENTS 652112 10/1937 Fed. Rep. of Germany ..... 401/117
2944336 11/1970 Fed. Rep. of Germany .
3635690 5/1988 Fed. Rep. of Germany .
1092603 11/1954 France ..... 401/102
781214 8/1957 United Kingdom ..... 401/102

*Primary Examiner*—Steven A. Bratlie
*Attorney, Agent, or Firm*—Steinberg, Raskin & Davidson

[57] ABSTRACT

A device for obturating an applicator apparatus comprising a body (2) fitted with an applicator brush (13) in contact with a product contained in a tank (R) and which is obturatable by a cap (1) which upon the obturation of the body actuates a sleeve (3) movably mounted in the body so as to perform the retraction into this sleeve of the applicator brush (13) accommodated inside of the sleeve (3) and fixedly mounted within the body and upon the opening of the body actuates the sleeve (3) in the reverse direction to disengage the applicator brush (13) from the sleeve (3) and thus allow its use after separation of the cap (1) from the body (2).

12 Claims, 2 Drawing Sheets

Fig. 1
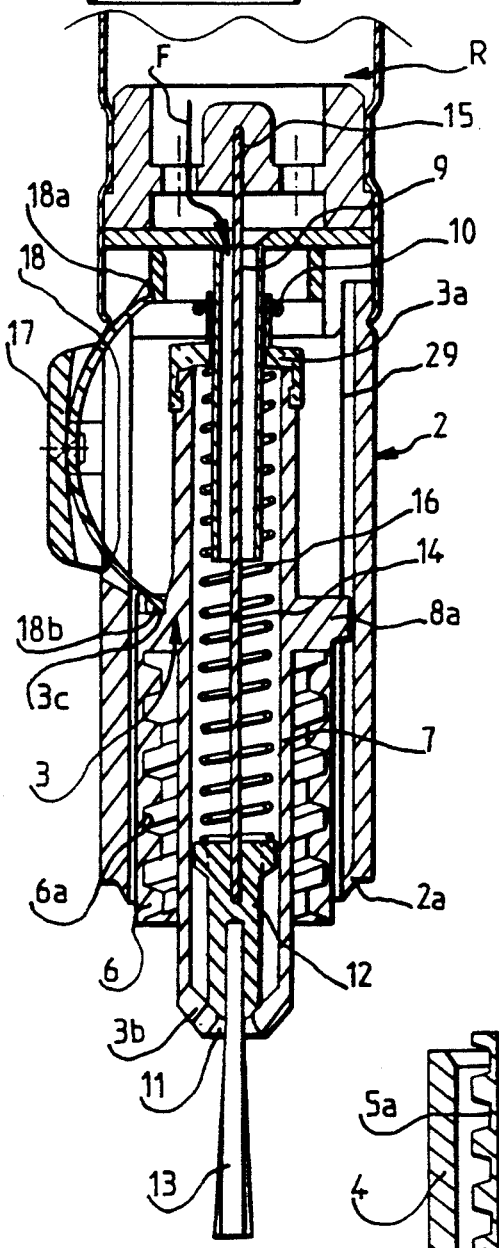
Fig. 2
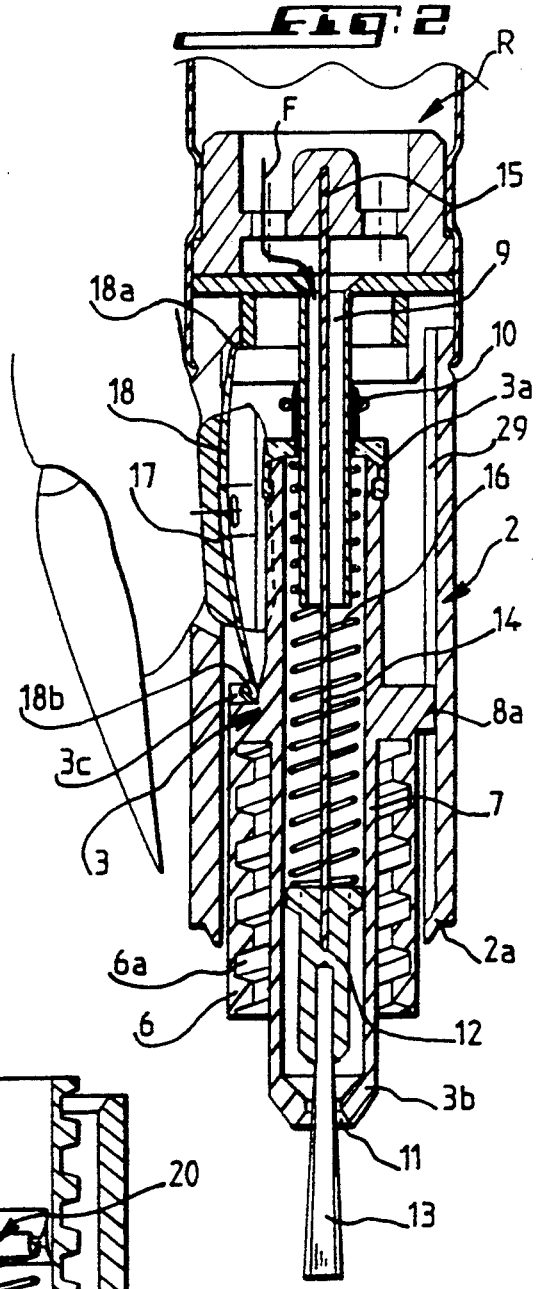
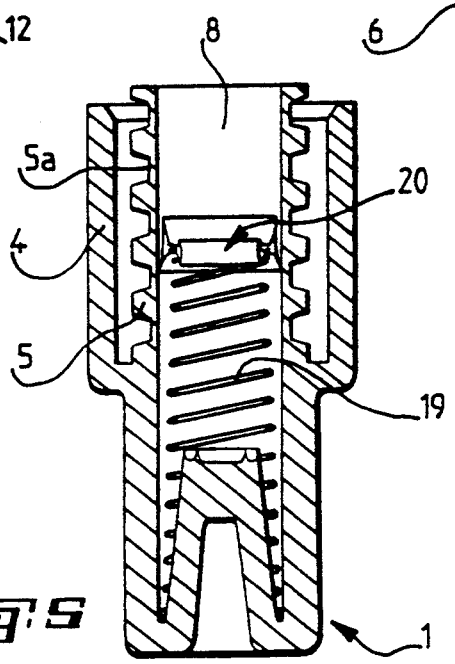
Fig. 5

DEVICE FOR OBTURATING AN APPLICATOR OF A LIQUID PRODUCT

BACKGROUND OF THE INVENTION

The present invention relates to a device for the obturation of an apparatus for the application of a viscous liquid product, such for example as nail varnish.

It is also directed to an applicator apparatus usable with this device.

In the prior art, applicator apparatus are known which are provided with an applicator brush in contact with a product contained in a tank, and which in a general manner are obturatable by a stopper the mounting of which on the body of the apparatus and the removal of which are controlling the putting out of service, i.e., closing, or in retracted position of the applicator brush and its putting into service, i.e., opening, or in position of egress and of use, respectively.

Such prior art devices are, for example, described in the documents DE-A-2,944,336 and DE-A-3,635,690.

In these references, however, the stopper directly actuates the applicator brush upon the closing or the opening of the container to carry out its retraction or its putting into service, respectively. It results therefrom that the mounting and the removal of the stopper may in the course of time deteriorate the brush or at least alter its qualities of fineness.

OBJECTS AND SUMMARY OF THE INVENTION

Therefore, it is an object of the present invention to remedy in particular the hereabove inconveniences by proposing an obturation device which does not risk damage to the applicator brush upon the closing and the opening of the container and which in addition permits a reliable and positive obturation which opposes the accidental flowing out of the liquid contained in the tank and remaining in contact with the applicator brush.

For that purpose, the invention has as its subject a device for the obturation of an apparatus for the application of any more or less viscous liquid product, which is fitted with an applicator brush in contact with the product contained in a tank and which may be obturated by a stopper the mounting of which on the body of the apparatus and the removal of which are controlling the putting out of service or in a retracted position of the applicator brush and the putting into service or in position of egress and of use, respectively, of this applicator brush. In the device, the stopper, upon the obturation of the body, actuates a sleeve or the like movably mounted in the body so as to provide the retraction into this sleeve of the applicator brush accommodated inside of the sleeve and fixedly mounted within the body. Upon the opening of the body, the stopper actuates the sleeve in the reverse direction to disengage the applicator brush from the sleeve and to thus permit its use after separation of the stopper from the body of the apparatus.

One thus understands already that the stopper does not risk damage to the applicator brush since it will act only upon the movable sleeve permitting the sleeve to completely cover the brush or to put it in position of use or in a position of being moved out of the sleeve.

According to another characteristic of this device, the stopper comprises a portion co-operating by screwing with the movable sleeve and a portion co-operating by abutment with the body of the container to perform, upon screwing, the retraction into the sleeve of the applicator brush which thus remains in close contact with the liquid product contained in the tank.

Otherwise, the screwing of the stopper will cause the attraction of the sleeve and the retraction of the applicator brush fixedly mounted within the container.

According to still another characteristic of the invention, the stopper is provided internally with a spring with which is associated a ring through which may extend the brush and cooperating with an aperture forming a seat in the sleeve as from the beginning of the mounting and of the screwing of the stopper onto the sleeve.

The invention is also directed to an applicator apparatus usable with an obturation device meeting either one of the hereabove characteristics and characterized in that the sleeve is, on the one hand, mounted in fluid-tight sliding relationship onto one portion of the container to remain in permanent communication therewith, and, on the other hand, is slidably mounted without rotation within the body.

This apparatus is further characterized in that one of the ends of the sleeve is mounted in sealed sliding relationship onto a tubular element extending the container and located along the axis of the body and of the sleeve whereas a spring housed within the sleeve is bearing between the afore-mentioned end and a valve member carrying the applicator brush made fast to the body.

According to another characteristic of this apparatus, the spring surrounding a rod or the like, accommodated within the sleeve and connecting the valve member to the body, constantly urges the end of the sleeve comprising the seat-forming opening to bear upon the valve member.

One should further specify that with the body of the apparatus is associated a push-button provided with a spring leaf capable of co-operating with a shoulder of the sleeve for actuating the sleeve in order to deliver liquid product to the applicator brush only when the stopper is disconnected from the body.

The body of the apparatus could constitute a head connectable onto the tank by any suitable means, such as screwing. Alternatively, this body could form one single element comprising a tank topped by a tubular portion comprising the sleeve and all its associated elements.

According to still another characteristic of the invention, the diameter of the aforesaid tubular element is substantially equal to the diameter of the aforesaid opening forming the seat through which may extend the brush the diameter of which is very close to that of the opening forming the seat.

Thus, upon unscrewing of the stopper, penetration of the sleeve into the body is caused and therefore the disengagement of the brush from the sleeve, and one advantageously avoids an uncontrolled egress of the product contained in the tank and which thus does not risk to escape out of the applicator apparatus.

BRIEF DEBCRIPTION OF THE DRAWINGS

Further characteristics and advantages of the invention will appear better in the detailed description which follows and refers to the annexed drawings given by way of example only and in which:

FIG. 1 is a view in axial and partial section (tank partially illustrated) of the applicator device shown in the position ready for use;

FIG. 2 is a view similar to FIG. 1 but on which the pushbutton is actuated for delivering liquid product such as nail varnish to the applicator brush;

FIG. 5 a view in axial section of a variant of the cap.

DETAILED DESCRIPTION OF THE INVENTION

Figure 3:
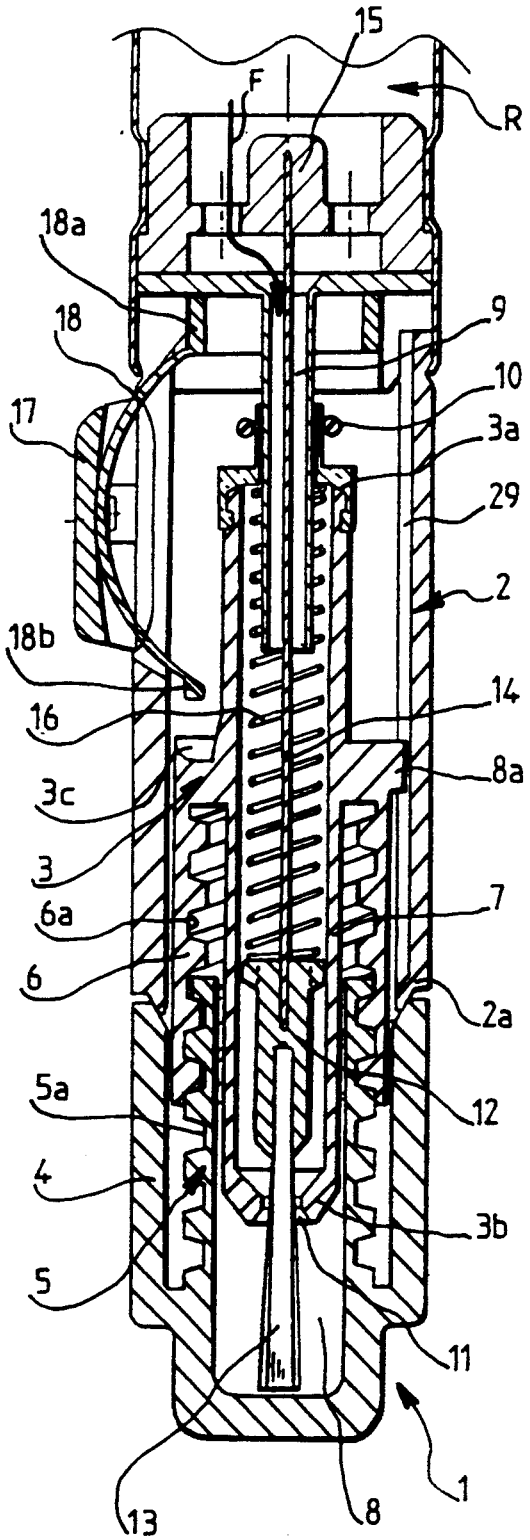
FIG. 3 is a view similar to the foregoing figures but showing the device at the beginning of the obturation by means of a stopper or cap according to the invention.
Figure 4:
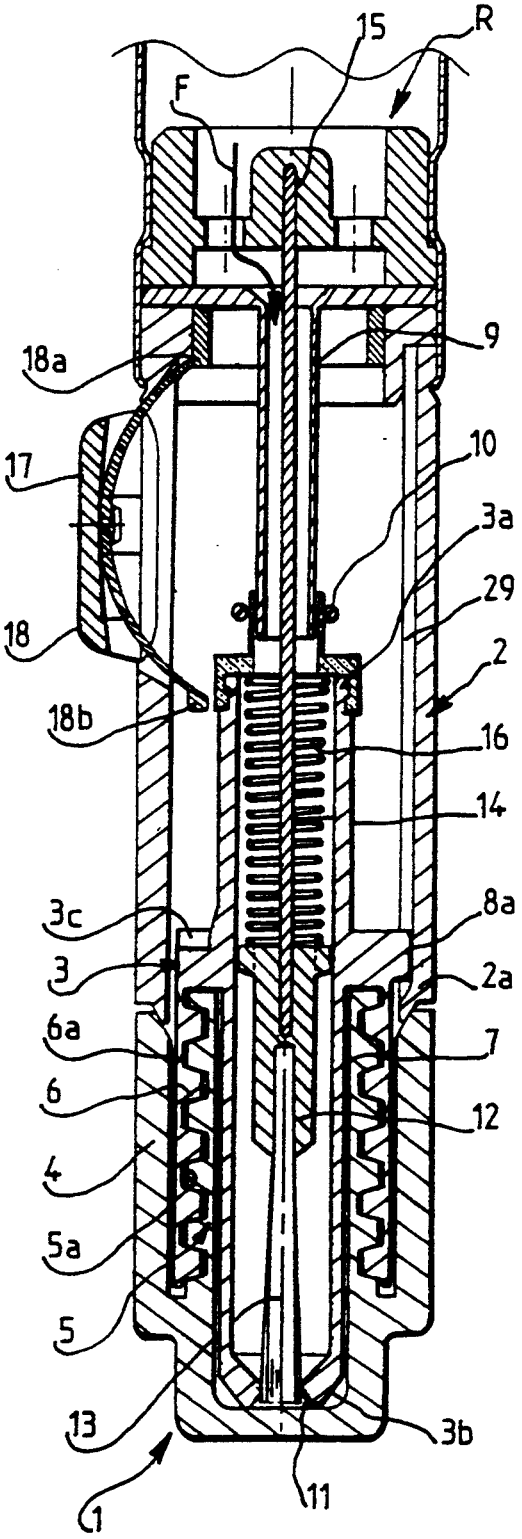
FIG. 4 is a view identical with FIG. 3 but showing the stopper or cap in the final position of obturation of the container.

Referring in particular to FIGS. 3 and 4, a device according to this invention essentially comprises a stopper 1 capable of obturating the body 2 of an applicator apparatus which comprises a tank R in permanent communication as shown by the arrow F with a sleeve 3 slidably mounted within the body 2 and capable of cooperating with the stopper or cap 1.

In the exemplifying embodiment shown in the FIGS. 3 to 5, the cap 1 comprises two concentric tubular walls, namely an external tubular wall or envelope 4 and an internal tubular wall 5 comprising a threading 5*a* external or in front of the wall 4.

Owing to the special configuration of the cap 1 with the threading 5*a* isolated between both tubular walls 4, 5, one advantageously avoids any possible dirtying of this threading by the product from the tank and therefore any possible risk of seizing of the cap on the apparatus. This advantage is particularly appreciable in the case where the product contained in the tank is nail varnish.

The movable sleeve 3, according to the example shown, itself also comprises two concentric tubular walls, namely on the one hand an external tubular wall 6 carrying an internal threading 6*a* and capable of inserting itself into the space between the tubular walls 4 and 5 of the cap 1 so that the threading 6*a* comes into engagement with the threading 5*a* and, on the other hand, an internal tubular wall 7 capable of locating itself inside of the stopper 1 within a recess 8. This recess is defined by the internal and threaded tubular wall 5 of the stopper as shown in FIGS. 3 and 4.

One could perfectly well without leaving the scope of the invention provide the sleeve 3 as one single and externally threaded tubular wall co-operating with an internally threaded and itself also single tubular wall of the stopper or cap 1.

The sleeve 3 is slidably mounted without rotation into the body 2 and for that purpose it comprises a snug or the like 8*a* cooperating with a groove or other similar means 29 provided on the internal periphery of the body 2. The sleeve 3 comprises an end portion 3*a* mounted in fluid-tight sliding relationship onto a tubular element 9 made fast to the body and extending in a way the tank R so that the sleeve 3 is in permanent communication with the said tank. As shown at 10, an elastic ring, or the like, gripping round in sealing relationship the end portion 3*a* of the sleeve 3 while permitting the sliding of the sleeve along the tubular extension 9. The sleeve 3 comprises an opposite end 3*b* provided with an opening 11 forming a seat for a valve member 12 fitted with an applicator brush 13 capable of passing through the opening 11.

The part 12 forming a valve member is housed inside of the movable sleeve 3 and is made fast to the body 2 of the container through the medium of a rod or other similar means 14. This rod is fastened at 15 onto one portion of the body 2 of the container and is located substantially along the axis of the tubular extension 9 and of the sleeve 3. Thus, the position of the valve member 12 hence of the applicator brush 13 within the body 2 of the container is stationary and, as will be described later, it is the sleeve 3 which displaces itself with respect to the valve member upon the screwing or the unscrewing of the cap 1 to put the applicator brush 13 out of service or in service.

As shown at 16, a spring is arranged between the valve member 12 and the bottom of the sleeve 3 constituted by its end portion 3*a*. This spring 16 constantly urges the sleeve 3 in the direction of the tank R, i.e., constantly biases the opening forming the seat 11 into the position applied against the valve member 12, in which position the applicator brush 13 is projecting from the opening 11 as will be described in connection with the operation of the device.

On the body 2, a push-button 17 is mounted projecting from the body and provided with a spring leaf 18 having one end 18*a* which is made fast to the body 2 and the other end 18*b* of which may actuate the sleeve 3 under the effect of a pressure applied upon the pushbutton 17 as will be explained in detail later. The tank R, partially shown on the figures, may be connected in a removable or non-removable manner by any suitable means to the body 2. Likewise, without departing from the scope of the invention, this tank R could be made integral with the body 2, i.e., constitute one part of this body.

In the alternative shown in FIG. 5, the stopper 1 is internally provided with a spring 19 which retains a ring 20 capable of sliding within the recess previously mentioned and defined by the internal and threaded tubular wall 5 of the stopper.

This ring 20 permits to provide the fluid-tightness at the level of the end 3*b* of the sleeve 3 once one begins the screwing of the stopper 1 onto the body 2.

For a better understanding of the invention, the operation of the device according to this invention is hereinafter explained while referring successively to FIGS. 1 to 5.

When the stopper or cap 1 is removed as shown in FIG. 1, the spring 16 urges the sleeve 3 in the direction of the tank R so that the opening 11 is obturated by the valve member 12 carrying the applicator brush 13 which projects from the opening. In this position, the end 18*b* of the spring leaf 18 of the push-button 17 is bearing upon the sleeve 3 or more precisely upon a shoulder 3*c* which this sleeve forms at the level of the snug 8*a*.

Consequently, as shown in FIG. 2, upon exerting a pressure with the finger upon the push-button 17, the sleeve 3 will be pushed against the force exerted by the spring 16 so that the opening 11 of the sleeve will disengage itself from the valve member 12 and allow the liquid contained in the tank R to soak the applicator brush 13 at the level of its portion located inside of the sleeve 3. The male or female user will be able in the course of the utilization and at will to pull out liquid contained in the tank R by more or less pressing the push-button 17 towards the axis of the apparatus.

This option of being able to meter the impregnation of the brush with the product exactly in accordance with the needs of the user constitutes an indisputable advantage over numerous known applicators which are only dispensing some product continuously or according to non meterable quantities thereby risking to provide an undesirable excessive flow.

At the end of the utilization as shown in FIG. 3, the user will be able to screw the stopper or cap 1 with its internal and threaded tubular portion 5 onto the sleeve 3, i.e., more precisely onto the external and threaded tubular portion 6 of this sleeve. Upon the screwing, the external tubular portion 4 of the cap 1 will bear upon the end 2*a* of the body 2 of the apparatus. Thus, the sleeve 3 will be attracted by screwing towards the inside of the cap 1 whereas the valve member 12 will remain immovable since it is fastened by the rod 4 onto the body 2. Therefore, in proportion as the screwing of the cap 1 proceeds hence as the opening 11 is gradually moving away from the stationary valve member 12, the applicator brush 13 will gradually be caused to house itself into the sleeve 3 and this while smoothing the bristles or fibres of the brush 13 on the edge of the opening 11.

As seen with the stopper of FIGS. 3 and 4, the free ends of the tubular walls 4, 5 are located in planes very close to each other so that the obturation of the body 2 is performed forthwith through the bearing of the free end of the wall 4 upon the end 2*a* of the body 2 and this before the beginning of the screwing. It is further important to remark here that the putting in place and the screwing of the cap 1 could, in no case, damage the applicator brush 13 which in a way will retract itself into the sleeve 3 as the screwing of the cap is proceeding.

At the end of the screwing of the cap 1 and as shown in FIG. 4, the return spring 16 is compressed, the applicator brush is fully retracted inside of the sleeve 3 and the bottom of the cap 1 is caused to obturate the opening 11.

It is to be noted that in this position, on the one hand, the applicator brush 13 remains in contact with the liquid or the vapors thereof contained in the tank R, which advantageously avoids any possible drying of the brush in case of non-use, and, on the other hand, the spring leaf 18 of the push-button 17 may no longer operate the sleeve 3 with its end 18*b*, even in case of accidental pressure upon the push-button.

Of course to put the device again in position of service from the closed position visible on FIG. 4, it will suffice to effect the operations reverse from those described hereinabove, i.e. to unscrew the cap 1, which under the effect of the spring 16, will cause the retraction of the sleeve 3 into the body 2 until the opening forming a seat 11 of the sleeve 3 will be caused to bear upon the valve member 12 as shown on FIG. 1.

The operation which has just been described will be exactly the same with the variant of cap illustrated in FIG. 5 with the difference that, here, from the beginning on the screwing of the stopper to obturate the container, the ring 20 will elastically bear upon the end 3*b* of the sleeve 3 so that the liquid contained in the apparatus may not escape upon the opening of the aperture 11 caused by the screwing of the stopper. Of course, as explained hereabove, the free end of the tubular wall 4 of the stopper will also bear from the start of the screwing upon the end 2*a* of the body 2 to thus carry out its obturation and to constitute an additional safety against the escape of the product.

One has thus provided, according to the invention, a device for the obturation of an applicator apparatus which avoids any possible damage to the applicator brush upon the opening and the closing of the apparatus, which provides a safety against the accidental delivery of product when the container is closed and which avoids any drying of the applicator brush when the apparatus is closed since the brush will be bathed in the liquid contained in the sleeve in permanent communication with the tank.

The invention is of course not at all limited to the embodiments described and illustrated which have been given by way of example only.

Thus the material constituting the body of the container and the stopper may be any material, the co-operating shapes of the stopper and of the sleeve could be other than those shown and the means for actuating the sleeve by the push-button could be others than a spring leaf.

Likewise the sleeve co-operating with the stopper could be connected to the tank in a manner other than that shown.

This means that the invention comprises all the technical equivalents of the means described as well as their combinations if the latter are effected according to its gist.

I claim:

1. Device for the obturation of an apparatus for the application of a liquid product, comprising a body having a tank for containing a liquid product, an applicator brush mounted in said body in connection with said tank, a sleeve movably mounted in said body, said sleeve comprising an external tubular wall and a concentric internal tubular wall, said external wall having a threading on an interior surface, and a stopper for obturating said applicator brush, said stopper being arranged to cooperate with said sleeve to cause said applicator brush to be exposed when in use and to be covered when not in use, said stopper comprising an external tubular wall and a concentric internal tubular wall, said internal wall of said stopper having a threading on an outer surface such that, upon screwing and unscrewing said stopper on said body, said external wall of said sleeve is inserted between said internal wall of said stopper and said external wall of said stopper, and said threading on said external wall of said sleeve cooperates with said threading on said internal wall of said stopper, said external wall of said stopper being arranged to abut with said body.

2. Device according to claim 1, characterized in that the stopper (1) is internally provided with a spring (19) with which is associated a ring (20) through which may extend the brush (13) and co-operating with an opening forming a seat (11) in the sleeve (3) from the beginning of the mounting or of the screwing of the stopper (1) onto the said sleeve.

3. Apparatus for the application of a liquid product and usable with an obturation device according a to claim 1, characterized in that the sleeve (3) is on the one hand mounted in fluid-tight sliding relationship onto one portion (9) of the tank (R) to remain in permanent communication with the latter and is on the other hand slidably mounted without rotation within the body (2).

4. Applicator apparatus according to claim 3, characterized in that one (3*a*) of the ends (3*a*, 3*b*) of the sleeve (3) is mounted in sealed sliding relationship onto a tubular element (9) extending the tank (R) and located along the axis of the body (2) and of the sleeve (3) whereas a spring (16) accommodated within the sleeve (3) is bearing between the said end (3*a*) and a valve member (12) carrying the applicator brush (13).

5. Applicator apparatus according to claim 4 characterized in that the spring (16) surrounding a rod (14) housed within the sleeve (3) and connecting the valve member (12) to the body (2) is constantly urging the end (3*b*) of the sleeve comprising the opening forming a seat (11) to bear upon the said valve member.

6. Applicator apparatus according to one of claim 1, characterized in that with the aforesaid body (2) is associated a push-button (17) provided with a spring leaf (18) capable of co-operating with a shoulder (3*c*) of the sleeve (3) for actuating the latter in order to deliver liquid product to the applicator brush (13) only when the stopper (1) is disconnected from the body (2).

7. Applicator apparatus according to claim 1, characterized in that the aforesaid body (2) constitutes a head connectable onto the tank (R).

8. Apparatus according to claim 5, characterized in that the diameter of the aforesaid tubular element (9) is substantially equal to the diameter of the aforesaid opening forming a seat (11) through which may extemd the brush (13) the diameter of which is very close to that of the said opening forming a seat.

9. The device of claim 1, wherein the liquid product is nail varnish.

10. The device of claim 1, wherein said stopper has a recess in which said applicator brush is situated when the device is obturated by said stopper.

11. The device of claim 1, further comprising a valve member arranged in said body and connected to said applicator brush, said valve member contacting said sleeve at one end of said sleeve closest to said applicator brush, and means to separate said sleeve from said valve member to cause the liquid to flow to said applicator brush.

12. The device of claim 11, wherein said means comprise a push-button having a spring-leaf, said spring-leaf contacting said sleeve such that upon depressing said push-button, said sleeve is moved relative to said valve member.

* * * * *